US005494246A

United States Patent [19]

McCarthy et al.

[11] Patent Number: 5,494,246

[45] Date of Patent: Feb. 27, 1996

[54] PASSIVE LOCK FOR END PANEL ASSEMBLY

[75] Inventors: Michael T. McCarthy, Spring Lake; Wayne Miedema, Holland; Paul A. Glashouwer, Byron Center; Mark A. Brunsink, Wyoming, all of Mich.

[73] Assignee: Haworth, Inc., Holland, Mich.

[21] Appl. No.: 261,495

[22] Filed: Jun. 17, 1994

[51] Int. Cl.[6] ..... A47B 96/06

[52] U.S. Cl. ..... 248/221.11; 211/192

[58] Field of Search ..... 248/222.1; 211/192, 211/243; 403/252, 255, 254; 108/108

[56] References Cited

U.S. PATENT DOCUMENTS

| | | | |
|---|---|---|---|
| 3,680,711 | 8/1972 | Brucker | 211/192 X |
| 4,101,231 | 7/1978 | Streib | 403/252 |
| 4,133,433 | 1/1979 | Wolf | 403/255 X |
| 4,198,913 | 4/1980 | Haworth et al. . | |
| 4,222,542 | 9/1980 | Wilson et al. . | |
| 4,693,383 | 9/1987 | Fenwick | 403/254 X |
| 4,733,841 | 3/1988 | Wilson . | |
| 5,022,621 | 6/1991 | Quest | 248/243 X |
| 5,131,781 | 7/1992 | Klein | 403/254 |
| 5,237,791 | 8/1993 | Scanlan | 403/252 X |

FOREIGN PATENT DOCUMENTS

| | | | |
|---|---|---|---|
| 383576 | 1/1965 | Switzerland | 248/222.1 |
| 921003 | 3/1963 | United Kingdom | 211/192 |
| 2044079 | 10/1980 | United Kingdom | 211/192 |

OTHER PUBLICATIONS

Sketch A (1 page) and Photo A (1 page) relating to the prior art arrangement which is discussed in the application starting at line 16 of page 3 and extending through line 5 of page 4.

*Primary Examiner*—J. Franklin Foss

*Attorney, Agent, or Firm*—Flynn, Thiel, Boutell & Tanis

[57] ABSTRACT

A one-piece non-load bearing passive locking member for releasably securing an end panel assembly to a slotted upright. The locking member includes a base part having an aperture extending therethrough. A spring part is formed in a first end edge of the base part for urging the locking member into locking engagement with a slot of the upright, and a locking tab is formed in a second end edge of the base part opposite the first end edge for lockingly engaging with the slot. A hollow guide part extends transversely from the base part and has a cantilevered arm extending transversely within the hollow guide part from a wall of the guide part, and a planar spring compression limiting part extends at least partially over the spring part from the wall of the guide part. A retaining pin extends longitudinally through the hollow guide part and from a free end of the arm in a direction transverse to the base part. The retaining pin has a free end extending beyond the base part to lockingly retain the locking member within a T-shaped slot of an end panel forming a part of a furniture component.

16 Claims, 4 Drawing Sheets

PASSIVE LOCK FOR END PANEL ASSEMBLY

FIELD OF THE INVENTION

This invention relates to a locking device, and more specifically, a one-piece passive lock for releasably securing an end panel assembly to a slotted upright.

BACKGROUND OF THE INVENTION

Shelves and the like have conventionally been supported on slotted uprights or rails by utilizing support brackets which employ a plurality of vertically-spaced, L-shaped hooks which project through a plurality of spaced slots in the upright. While this basic bracket-and-upright structure cooperates in a desirable manner to provide both strength and convenience of assembly, nevertheless this structure has proven undesirable in some instances. One of the primary disadvantages of this structure is the difficulty in insuring that the support brackets are securely seated on the upright. In many instances the support brackets are improperly seated and, in time, may become accidentally dislodged due to application of an upward external force thereto. This is obviously undesirable.

In an attempt to eliminate this disadvantage, numerous brackets and lock assemblies have been devised which provide for automatic locking of the furniture component to the upright when the furniture component is properly seated on the upright.

U.S. Pat. No. 4,222,542, issued on Sep. 16, 1980 to the Assignee of the present invention, discloses a one-piece load bearing support bracket fixed to an end panel of a furniture component for automatically positively locking to an upright when properly seated to prevent the accidental upward movement of the furniture component relative to the upright. While the one-piece support bracket has proven satisfactory with respect to its ability to lock to the upright and prevent accidental dislodging, nevertheless the support bracket possesses features which have made its use somewhat cumbersome. For example, during a multi-step manufacturing process, the load bearing support bracket is first stamped from a flat sheet of high-strength alloy steel, and then suitably bent so as to form a base and a hook plate. During the assembly process, the support bracket requires the use of screws to fixedly attach the support bracket to an end panel. Further, removal of an installed furniture component such as a cabinet having a properly locked support bracket fixedly secured thereto requires the use of a tool such as a screwdriver or the like, and requires gaining access to the locked support bracket from within the cabinet through a cutout in the end panel.

Lock assemblies serve the same function of automatically locking a furniture component to an upright when properly seated to prevent accidental upward movement. One conventional non-load bearing passive lock assembly includes a metal base plate adhesively bonded to, or otherwise conventionally mounted in a corresponding recess in a side surface of an end panel adjacent a rear edge thereof. The metal base plate includes a horizontally extending slot therethrough which slidably retains an elongate locking tab extending rearwardly past the rear edge of the end panel. The locking tab is urged rearwardly by a spring part interposed between a forward end of the locking tab and an end wall of the slot. The locking tab is automatically urged into a slot of the upright when a load bearing support bracket secured to the end panel is properly seated on the upright. When properly engaged with a slot of the upright, the locking tab prevents L-shaped hooks on the support bracket from becoming accidentally dislodged due to the application of an upward external force thereto. The above described assembly unnecessarily requires multiple components, adds unnecessary weight to the furniture component, and requires a time consuming mounting procedure which can only effectively be performed as part of a manufacturing process.

Another conventional lock assembly includes a plastic one-piece, non-load bearing, passive lock which serves the same function mentioned above, and a load bearing support bracket which retains the lock in a slot formed in an end panel. In particular, an end panel is provided with a horizontally extending T-shaped slot or recess. The recess includes a vertical recess portion which communicates with a rear edge of the end panel and a horizontal recess portion which communicates with a side surface of the end panel. The T-shaped recess slidably receives therein the one-piece lock having a flat base part positioned within the vertical recess portion. The base part includes a tab integrally formed in, and extending rearwardly from a central portion of a rear edge of the base part. The tab and rear edge cooperate to form a shoulder portion of the lock. The base part also includes a spring part integrally formed in, and extending forwardly from a forward edge of the base part. A narrow slot-like guide part extends transversely from the base part within the horizontal recess portion of the T-shaped recess. The lock is retained within the recess by at least a portion of a conventional load bearing support bracket secured to the rear edge of the end panel. The support bracket extends across a portion of the T-shaped recess and bears against the shoulder portion of the lock which is urged rearwardly by the spring part.

During manufacturing, the aforementioned lock is loosely inserted into the T-shaped recess before the support bracket is mounted to the end panel using screws or the like. The support bracket contacts the shoulder portion of the lock and urges the lock at least partially forwardly against the action of the spring part to thus load the spring part and retain the lock within the recess. During installation, the tab, extending rearwardly past the support bracket, is automatically urged into positive locking engagement with a slot of the upright when the load bearing support bracket is properly seated on the upright.

The removal of an installed furniture component having the above lock properly engaged with the upright requires that the lock be urged forwardly to disengage the tab from the slot of the upright. During removal, care must be taken not to damage the plastic spring part by urging the lock too far forward and thus overly compressing the spring part. If damaged, the support bracket must unfortunately be removed from the end panel before replacing the damaged lock.

Accordingly, it is an object of the present invention to provide an improved one-piece non-load bearing passive lock for releasably securing an end panel assembly to a slotted upright of a wall panel assembly.

More specifically, the one-piece lock in a preferred embodiment of the present invention includes a planar rectangular base part having an aperture extending therethrough. A spring part is formed at a first end edge of the base part. A locking tab is formed at a second end edge of the base part opposite the first end edge. The base part, spring part and locking tab are each oriented in the same plane. A hollow guide part is aligned with the aperture and extends transversely from a first surface of the base part. A cantilevered arm extends transversely within the hollow guide part and is integrally joined to a wall of the guide part. A planar spring compression limiting part extends at least partially over the spring part from the wall of the guide part. A retaining pin extends longitudinally through the hollow guide part and the aperture from a free end of the arm in a direction transverse to the base part, and the retaining pin has a free end extending beyond a second surface of the base part opposite to the first surface.

It is another object of the present invention is to provide an end panel assembly for lockingly supporting a furniture component to an upright in a cantilevered relationship. More specifically, the end panel assembly includes a planar end panel forming a portion of the furniture component and having a T-shaped recess formed therein. The recess has a vertical recess portion which communicates with a rear end edge of the end panel, a horizontal recess portion communicates with a side surface of the end panel, and a slotted portion is intermediately positioned within an inner wall of the vertical recess portion. A support bracket is fixedly secured to the rear end edge of the end panel above the T-shaped recess and has a plurality of rearwardly-projecting downwardly-opening load-supporting L-shaped hooks engageable with the upright. A one-piece locking member is slidably retained within the recess and includes a planar base part slidably disposed within the vertical recess portion. An intermediate aperture extends transversely extending the base part. A spring part is formed in a first end edge of the base part and extends forwardly within the vertical recess portion. A locking tab is formed in a second end edge of the base part and extends rearwardly outside of the vertical recess portion. A hollow guide part is aligned with the aperture and extends within the horizontal recess portion transversely from the base part. A cantilevered arm extends transversely within the aperture from a wall of the guide part. A spring compression limiting part extends at least partially over the spring part from the wall within the horizontal recess. A retaining pin extends longitudinally through the aperture from a free end of the cantilevered arm, and the retaining pin has a free end thereof extending into the slotted portion of the recess.

An advantageous feature of the lock of the present invention is that, in one step, it can be inserted into the T-shaped recess of the end panel quickly and easily as part of an on-site furniture component installation procedure.

A further advantageous feature of the lock according to the present invention is that it is independently retained within the slotted portion of the recess by a retaining pin extending from a cantilevered arm.

Still a further advantageous feature of the lock of the present invention is that a spring compression limiting part is provided which prevents a spring part from being overly compressed, and thus damaged.

Another advantageous feature of the lock of the present invention is that it can be easily and quickly replaced without the removal other components of the end panel assembly.

Other objects and purposes of the present invention will be apparent to persons familiar with structures of this general type upon reading the following specification and inspecting the accompanying drawings.

Figure 1:
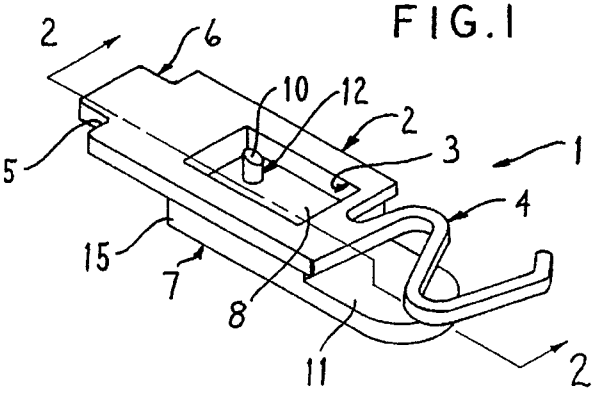
FIG. 1 is a perspective bottom view of a locking member according to the present invention.
Figure 2:
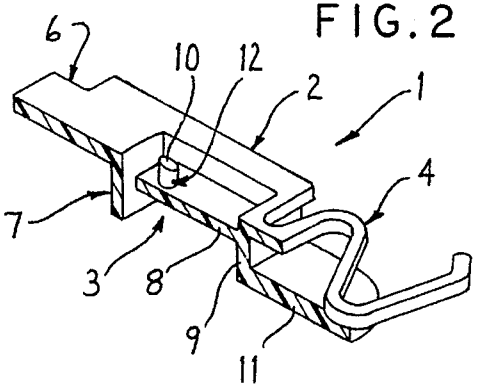
FIG. 2 is a sectional view of the locking member taken along the line 2—2 of FIG. 1.
Figure 4:
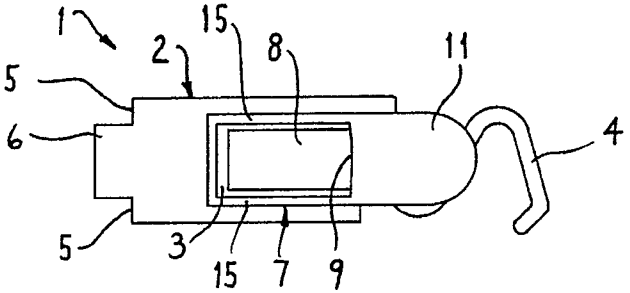
FIG. 4 is a top plan view of FIG. 3.
Figure 3:
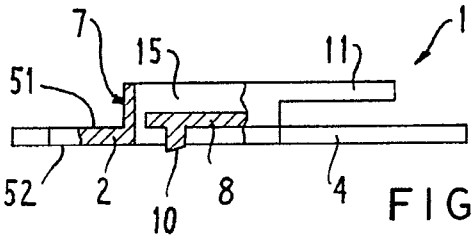
FIG. 3 is a side elevational view, partially in cross section, of the locking member.
Figure 5:
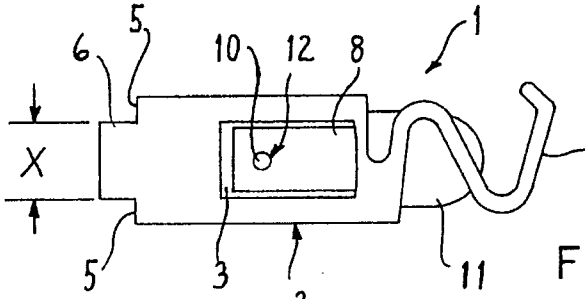
FIG. 5 is a bottom plan view of FIG. 3.

Certain terminology will be used in the following description for convenience in reference only, and will not be limiting. For example, the words "forwardly", "backwardly", "inwardly", "outwardly", "horizontal" and "vertical" will refer to directions in the drawings to which reference is made. These latter terms will also refer to the normal directional relationships utilized in conjunction with the locking member during normal usage thereof. The terminology will include the words specifically mentioned, derivatives thereof, and words of similar import.

DETAILED DESCRIPTION

Referring to FIGS. 1–5, there is illustrated a one-piece non-load bearing locking member 1 according to the present invention. This locking member 1 includes a planar, rectangular base part or plate 2 having a rectangular aperture 3 extending intermediately therethrough. A planar cantilevered resilient spring part 3 extends outwardly away from a first end edge of the base part 2. The spring part 4 has an S-shape so as to provide good resiliency in a narrow width profile substantially equal to or slightly greater than the width of the base part 2. A planar locking tab 6 extends outwardly away from a central portion of a second end edge of the base part 2 opposite the first end edge. The locking tab 6 has a width X which is less than the width of the base part 2. The locking tab 6 and the base part 2 cooperate to form a shoulder 5 along the second end edge of the base part 2. The base part 2, spring part 3 and locking tab 6 are all oriented in one plane. The aperture 3 is longitudinally offset from a geometric center of the base part 2 toward the spring part 4.

A hollow rectangular guide part 7 is aligned with the aperture 3 and extends transversely from a first side surface 51 of the base part 2. A resilient cantilevered arm 8 is attached to a wall 9 of the guide part 7, which wall 9 is adjacent the spring part 4. The cantilevered arm 8 extends transversely within the guide part 7 toward the locking tab 6 in a second plane parallel to the base part 2. A planar spring compression limiting part 11 is attached to the wall 9 and extends transversely from the guide part 7 in a third plane parallel to the base part 2. The compression limiting part 11 extends at least partially in overlapping relation to the spring part 4 but is sidewardly spaced therefrom.

A retaining pin 12 is attached to a free end portion of the cantilevered arm 8. The retaining pin 12 extends in a direction transverse (i.e. perpendicular) to the base part 2. The retaining pin 12 has a free end 10 which extends outwardly past a second side surface 52 of the base part 2 opposite the first side surface 51. The free end surface 10 of pin 12 is tapered inwardly as it extends toward the spring part 4.

The locking member 1 is preferably manufactured by an injection molding process using a thermoplastic material, preferably ABS plastic (Acrylonitrile-Butadiene-Styrene).

Figure 6:
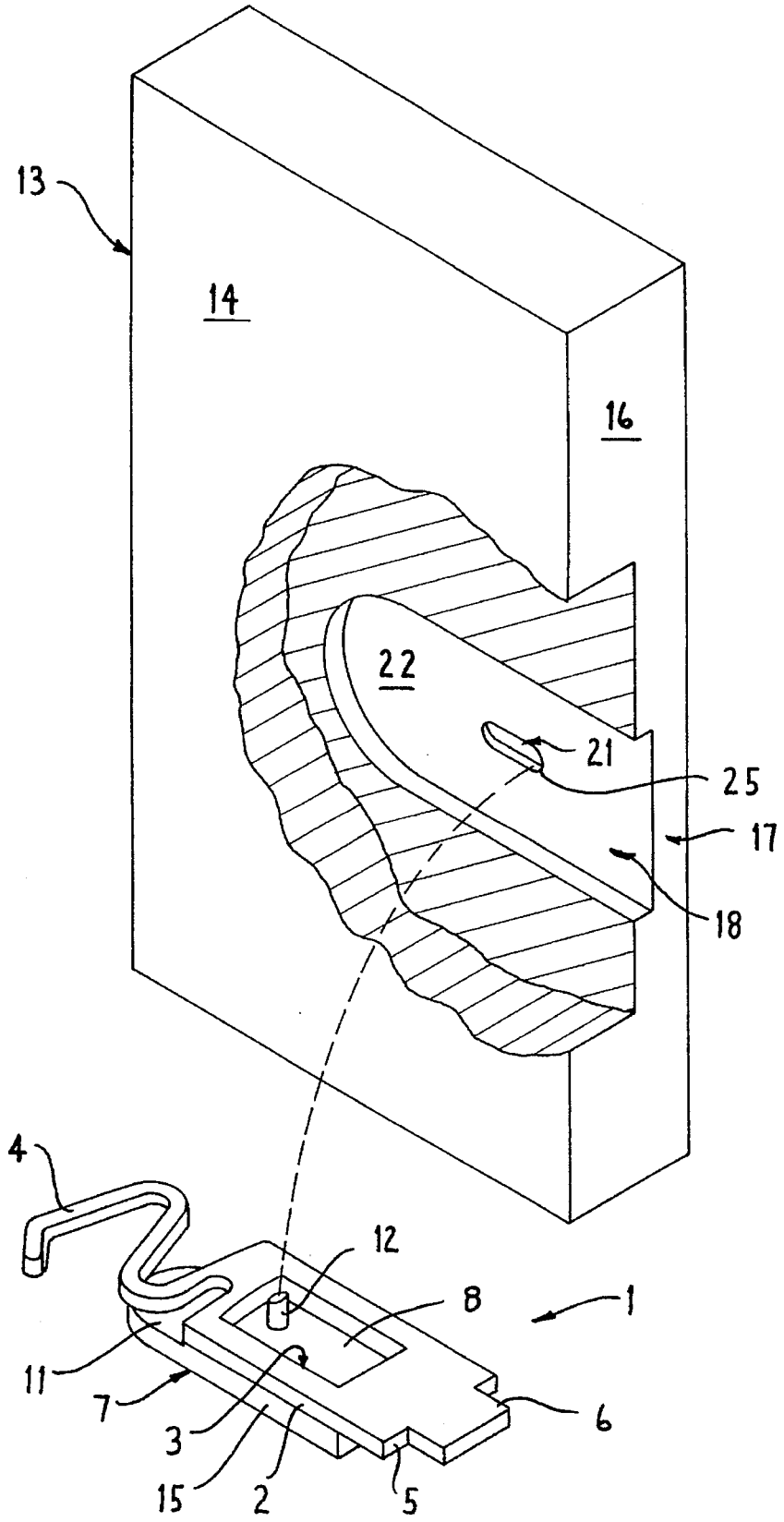
FIG. 6 is an enlarged fragmentary perspective view of a T-shaped slot in an end panel for receiving the locking member.
Figure 8:
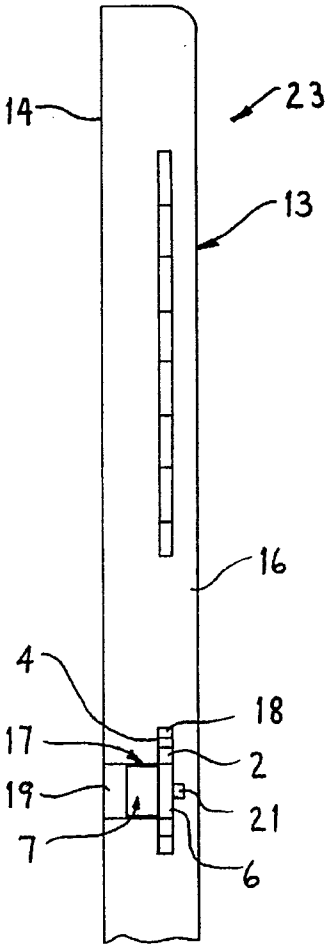
FIG. 8 is an elevational end view of the end panel assembly of FIG. 7.
Figure 7:
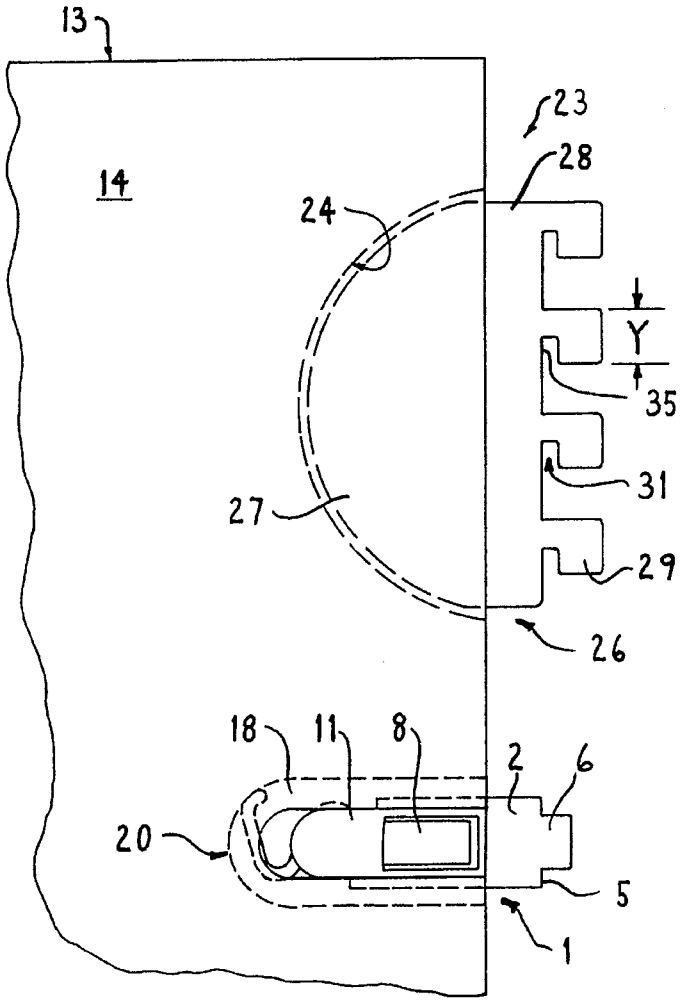
FIG. 7 is a side elevational view of the end panel assembly according to the present invention.

FIGS. 6–8 illustrate an end panel assembly 23 according to the present invention. The end panel assembly 23 includes a planar end panel 13 of a furniture component (not shown), such as a shelf unit. The locking member 1 is slidably retained within a recess or slot 17 formed in the end panel 13, and a load bearing support bracket 26 is fixedly secured within a second recess 24 of the end panel 13. The recess 17 is T-shaped in cross section in a direction transverse to a movement of the locking member 1 within the recess 17.

The end panel 13 conventionally comprises a flat pressed wood core having vinyl surfaces laminated thereon. The T-shaped recess 17 of the end panel 13 includes a vertical recess portion 18 which communicates with a rear end edge or surface 16 of the end panel 13 and which opens forwardly therefrom. The vertical recess portion 18 has a closed rounded end wall 20 at a longitudinally forward end thereof. The T-shaped recess 17 also includes a horizontal recess portion 19 which communicates with the vertical recess portion 17 at an inner side thereof, and communicates with an outer side surface 14 of the end panel 13 at an outer side thereof.

The vertical recess portion 18 includes a blind slot 21 intermediately positioned within an inner wall 22 of the vertical recess portion 18. The slot 21 defines a rearward shoulder 25 which is spaced forwardly apart from the rear end edge 16. Thus, the slot 21 is accessible solely from within the T-shaped recess 17.

The base part 2, spring part 4 and at least a portion of the locking tab 6 are slidably received within the vertical recess portion 18 of the T-shaped recess 17. The width of the base part 2 and/or spring part 4 are slightly less than the vertical height of the vertical recess portion 18 to facilitate sliding movement of the locking member 1 horizontally within the T-shaped recess 17.

The horizontal recess portion 19 forms a guide channel which slidably receives the hollow guide part 7. The side walls 15 of the hollow guide part 9 are spaced apart slightly less than the vertical height of the horizontal recess portion 19 to facilitate horizontal reciprocal movement of the locking member 1 within the T-shaped recess 17.

The blind slot 21 receives the free end 10 of retaining pin 12. A rearward movement of the locking member 1 within the T-shaped recess 17 is limited by the free end 10 of the retaining pin 12 abutting against the rearward shoulder 25 so that the shoulder 5 of the base part 2 extends substantially vertically aligned with the forward walls 35 in a static installed state.

The planar load bearing support bracket 26 includes a base plate 27 vertically received within, and fixedly secured within the second recess 24 of the end panel 13. The second recess is intermediately formed in a central portion of the rear end edge or surface 16, and spaced vertically apart from, and above the T-shaped recess 17. The base plate 27 is preferably adhesively bonded within the second recess 24 with any suitable commercially available bonding adhesive exhibiting high strength characteristics. Alternatively, the plate 27 may be secured with screws.

A hook plate 28 projects rearwardly from the base plate 27 and terminates in a plurality of vertically spaced downwardly opening L-shaped hooks 29. L-shaped hooks 29 define downwardly opening slots 31 each having a forward wall 35.

Figures 9A, 9B, 9C:
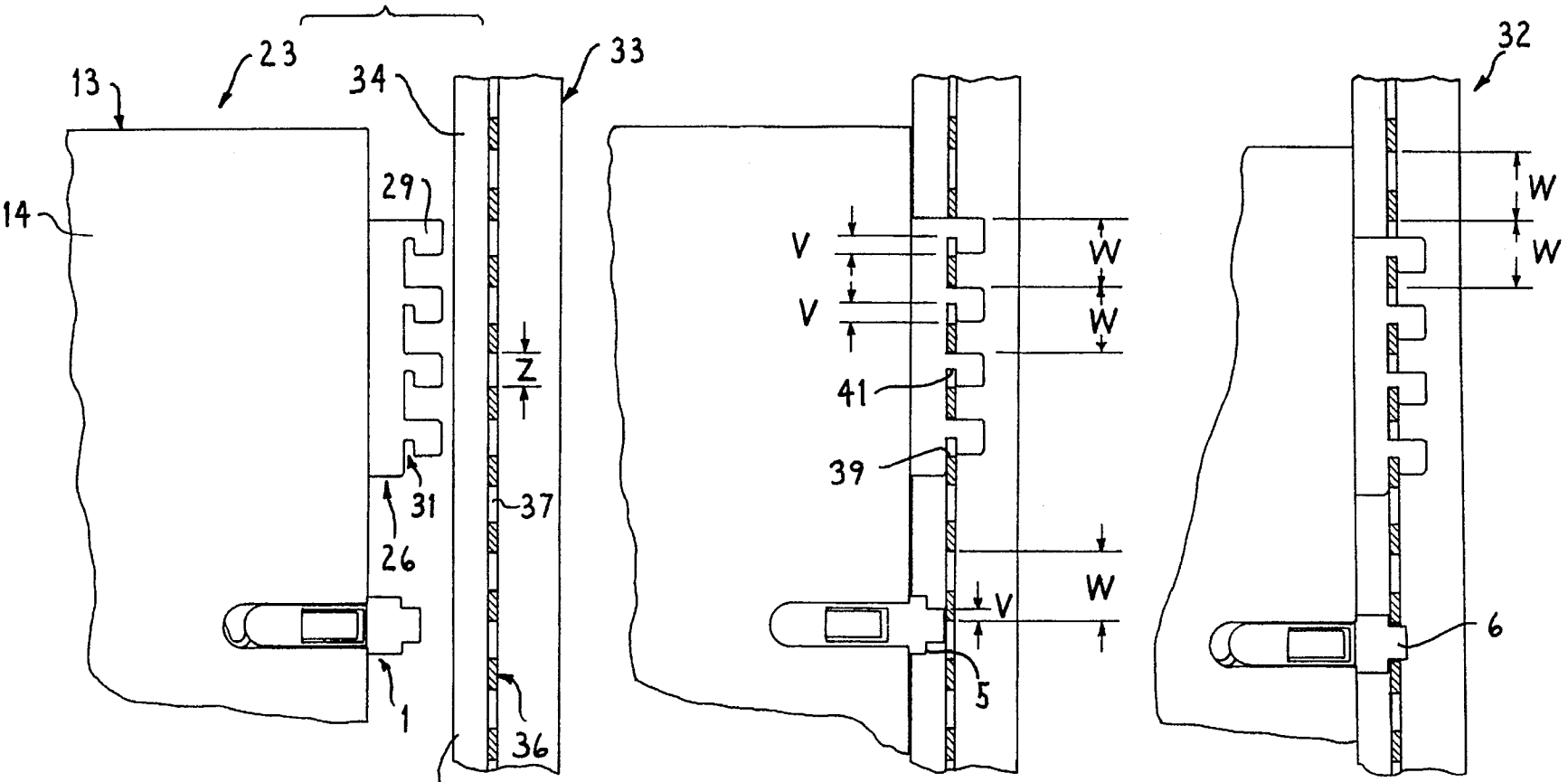
FIGS. 9A–9C are progressive side elevational views showing the end panel assembly being joined to a slotted upright.

FIGS. 9A–9C illustrate a wall panel assembly 32 according to the present invention. Wall panel assembly 32 includes a slotted upright or rail 33 associated with a wall panel (not shown) and the end panel assembly 23 hookingly engaged with the slotted upright 33.

To accommodate the support bracket 26, the upright 33 has a narrow slot-like recess 34 formed therein which opens horizontally forwardly through a front wall 38 thereof. The recess 34 extends vertically in the longitudinal direction of the upright. The recess 34 terminates in a rear wall 36 which has a plurality of vertically spaced slots 37 extending therethrough.

The slots 37 have a height dimension Z which substantially conforms to the height dimension Y of the hooks 29, and the width dimension X of the locking tab 6. Thus, the slots 37 permit the hooks 29 and the locking tab 6 of the end panel assembly 23 to pass therethrough to thereby secure the support bracket 26 to the upright 33.

The hooks 29 and the slots 37 are vertically spaced apart at an interval W which permits the hooks to engage with the slots 37 as described above. The T-shaped recess 17 and locking member 1, and more particularly the locking tab 6 is positioned so as to be offset from the interval W by about a distance V which corresponds to the vertical distance separating a lower surface 39 of each slot 37 from an upper surface 41 of each downwardly facing slot 37 as shown in FIG. 9B.

The structure of the hooks 29 and the tab 6, and their structural and operative relationship with the slotted upright 33 is substantially conventional.

In operation, the locking member 1 can be inserted into the end panel 13 as part of a manufacturing step or an installation step. In either case, the locking member 1 is inserted into the T-shaped recess 17 from the rear surface 16 of the end panel 13. The locking member is oriented with the spring part 4 facing forward, the base part 2 aligned with the vertical recess portion 18, and the hollow guide part 7 aligned with the horizontal recess portion 19.

As the locking member 1 is urged forwardly into the T-shaped recess 17, the spring part 4 compresses against front end wall 20 of the vertical recess portion 18, and the free end 10 of the retaining pin 12 contacts an edge of inner wall 22. The taper of the free end 10, forwardly and inwardly toward the base part 2, permits the retaining pin 12 and the cantilevered arm 8 to slightly resiliently deflect away from the inner wall 22 as the locking member is urged further into the T-shaped recess 17 against the action of the spring part 4. The locking member 1 is urged forwardly into the recess until the free end of the retaining pin 12 communicates with, and is resiliently forced inwardly into the slotted recess portion 21 by the return action of cantilevered spring arm 8. The locking member 1 is thus retained within the T-shaped recess 17 by the action of the free end 10 of the retaining pin 12 projecting into and being lockingly confined within the slotted recess portion 21. The locking tab 6 remains outside the recess 17 with the shoulder 5 of the base part 2 extending substantially vertically aligned with the forward walls 35 when the pin 12 is abuttingly engaged with the rearward shoulder 25 of the slot 21.

Thus, in a static installed state, the locking member 1 is independently retained within the T-shaped recess 17 by the rearward urging of the loaded spring part 4 so that the free end of the retaining pin 12 abuts against the shoulder 25 of the slotted recess portion 21.

Once the locking member 1 has been inserted into the end panel assembly 23 as described above, a furniture component incorporating the end panel assembly 23 can then be mounted to the upright 33 of a wall panel.

The L-shaped hooks 29 of the support bracket 26 are first aligned with corresponding slots 37 of the upright 33 as shown in FIG. 9A. When the hooks 29 and slots 37 are aligned, the locking tab 6 will be misaligned with a corresponding slot by about the distance V. The hooks 29 are then inserted into, and through the slots 37 until the forward walls 35 of the downwardly opening slots 31 abut against the rear wall 36 of the upright as shown in FIG. 9B.

As the hooks are inserted into the slots 37, the locking tab 6 will abut against the rear wall 36 of the upright and be driven forwardly into the T-shaped recess against the action of the spring part 4. The locking member 1 is urged forwardly until the end edge of the locking tab 6 is vertically aligned with the forward wall 35 of the hooks and/or until the spring compression limiting part 11 abuts against the radial end wall 20 of the vertical recess portion 18.

The end panel assembly 23 is free to move downwardly approximately the distance V relative to the upright once the hooks 29 pass completely through the slots 37. More specifically, the forward walls 35 of the support bracket 26 move downwardly along the end wall 36 until the end wall is hookingly retained within the downwardly opening slots 31 of the support bracket.

The locking tab 6 correspondingly moves downward relative to the upright. The locking tab 6 clears the end wall 36 and thus aligns with a corresponding slot 37 of the upright when the end wall is retained within the slots 31. The spring part 4 urges or snaps the locking member 1, and more particularly the locking tab 6 rearwardly into the aligned slot 37 until the shoulder 5 abuts the end wall 36 and/or the free end 10 of the retaining pin 12 abuts the rearward shoulder 25 of the blind slot 21. Thus, any upward external force applied to the furniture component will not result in the support bracket 26 becoming dislodged from the upright because the locking tab 6 prevents upward relative movement between the support bracket and the upright until the locking member is manually urged forwardly such as during a removal step.

During removal of the furniture component from the wall panel, a finger or tool is inserted into the hollow guide part 7 of the locking member 1 and a forward force is applied to the wall 9 to disengage the locking tab 6 from the slot 37. The forward movement of the locking member 1 is limited by the spring compression limiting part 11 which abuts against the end wall 20 of the vertical recess portion 18. The limiting part 11 prevents over compression of the spring part 4 thus preventing damage thereto. Once the locking tab 6 has cleared the slot 7, the furniture component is removed by an upward and then forward movement of the furniture component to disengage the support bracket 26 from the upright 33.

Replacement of the locking member 1 can be accomplished by urging the locking member rearwardly while using a small tool such as a screwdriver to pivot the free end of the cantilevered arm 8 so that the free end 10 of the retaining pin 12 clears the slotted recess portion 21.

While the invention discloses the end panel assembly having one load bearing support bracket, it will be appreciated that the end panel assembly can include a second load bearing support bracket mounted thereto, which second support bracket could be mounted above or below the locking member.

Further, the locking member may include other configurations of a spring part which operate in a suitable manner to urge the locking member rearward.

Although a particular preferred embodiment of the invention has been disclosed in detail for illustrative purposes, it will be recognized that variations or modifications of the disclosed apparatus, including the rearrangement of parts, lie within the scope of the invention.

The embodiments of the invention in which an exclusive property right or privilege is claimed are defined as follows:

1. A one-piece locking member for releasably securing an end panel assembly of a furniture component to a slotted upright, the locking member comprising:

a plate-like rectangular base part;

a spring part formed at a first end edge of said base part;

a locking tab formed at a second end edge of said base part opposite said first end edge, said base part, spring part and locking tab each being oriented in the same plane;

a guide part fixed to and extending transversely from a first side surface of said base part, and an aperture formed in and extending transversely through said base and guide parts;

a cantilevered arm extending transversely into said aperture from a surrounding wall thereof;

a planar spring compression limiting part extending outwardly from said wall of said guide part which at least partially overlaps said spring part; and a retaining pin extending outwardly of said aperture from a free end of said arm in a direction transverse to said base part, said retaining pin having a free end thereof extending beyond a second side surface of said base part which is opposite to said first side surface.

2. The locking member according to claim 1, wherein said spring part is an S-shaped cantilever provided with a narrow width profile.

3. The locking member according to claim 1, wherein the locking member is manufactured from a thermoplastic material.

4. The locking member according to claim 1, wherein said free end of said retaining pin is tapered inwardly and toward said spring part and said base part.

5. An end panel assembly for lockingly supporting a furniture component on a slotted upright of a wall panel in a cantilevered relationship, the end panel assembly comprising:

a planar end panel forming a portion of the furniture component, said end panel having a recess formed therein and a slot formed within the end panel and communicating with the recess;

a support bracket fixedly secured to a rear end edge of said end panel above said recess and having a plurality of rearwardly-projecting downwardly-opening load-supporting hooks engageable with the slotted upright; and a one-piece locking member slidably positioned within said recess, said locking member including means for independently retaining said locking member in said recess, said means including a resilient detent which cooperates with said slot to retain said locking member within said recess.

6. The end panel assembly according to claim 5, wherein said recess is T-shaped in cross section and includes a vertical recess portion communicating with a rear end edge of said end panel, a horizontal recess portion communicating with a side surface of said end panel, and a slotted portion intermediately positioned within an inner wall of said vertical recess portion.

7. The end panel assembly according to claim 6, wherein said locking member further includes a planar base part slidably disposed within said vertical recess portion and having an intermediate aperture transversely extending through said base part, a spring part formed in a first end edge of said base part and extending forwardly within said vertical recess portion, a locking tab formed in a second end edge of said base part and extending rearwardly outside of said vertical recess portion, a hollow guide part aligned with said aperture and extending within said horizontal recess portion transversely from said base part, a cantilevered arm extending transversely within said aperture from a wall of said guide part, and a spring compression limiting part extending at least partially over said spring part from said wall within said horizontal recess.

8. The end panel assembly according to claim 7, wherein said means for independently retaining includes a retaining pin extending longitudinally through said aperture from a free end of said cantilevered arm, said retaining pin having a free end thereof extending into said slotted portion of said recess to retain said locking member within said T-shaped recess.

9. The end panel assembly according to claim 8, wherein said free end of said retaining pin is tapered toward said spring part and said base part to permit easy insertion of said locking member into said T-shaped recess while preventing said free end of said retaining pin from escaping from said slotted portion.

10. The end panel assembly according to claim 7, wherein said spring part is S-shaped to provide good resiliency with a narrow width profile.

11. The end panel assembly according to claim 7, wherein said locking member is manufactured from a thermoplastic material.

12. The end panel assembly according to claim 11, wherein said thermoplastic material is ABS plastic.

13. The end panel assembly according to claim 6, wherein said support bracket includes a base plate retained within a second recess intermediately formed within an end surface of said wall panel.

14. The end panel assembly according to claim 13, wherein said base plate is adhesively bonded to said second recess.

15. The end panel assembly according to claim 5, wherein said hooks are engaged with a slotted upright having a plurality of vertically-spaced apart slots extending through a rear wall of a vertical recess thereof.

16. The end panel assembly according to claim 15, wherein said hooks and said vertically spaced-apart slots are each vertically spaced apart at an interval, and said locking tab is positioned offset from said interval.

* * * * *